US009478126B2

(12) United States Patent
Berziel et al.

(10) Patent No.: US 9,478,126 B2
(45) Date of Patent: Oct. 25, 2016

(54) REMOTE AND CONTROLLER SYNCHRONIZATION FOR AUTOMATED FURNITURE CONTROLS

(71) Applicant: L&P PROPERTY MANAGEMENT COMPANY, South Gate, CA (US)

(72) Inventors: Braden S. Berziel, Carthage, MO (US); Ryan Edward Chacon, Carthage, MO (US); Vinod Gopalakrishnan, Carthage, MO (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 14/754,628

(22) Filed: Jun. 29, 2015

(65) Prior Publication Data

US 2015/0302739 A1 Oct. 22, 2015

Related U.S. Application Data

(63) Continuation-in-part of application No. 13/749,108, filed on Jan. 24, 2013, now Pat. No. 9,070,280.

(51) Int. Cl.
*G08C 17/02* (2006.01)

(52) U.S. Cl.
CPC ..... *G08C 17/02* (2013.01); *G08C 2201/20* (2013.01)

(58) Field of Classification Search
CPC .. G08C 17/02; G08C 2201/20; A61G 7/002; A61B 5/6891
USPC ..... 340/12.25, 12.28, 3.2, 4.3, 5.1; 370/241; 725/37; 455/41.1, 41.2
See application file for complete search history.

(56) References Cited

U.S. PATENT DOCUMENTS

| | | | | |
|---|---|---|---|---|
| 8,533,475 | B2 | 9/2013 | Frikart et al. | |
| 8,544,054 | B2 | 9/2013 | Reams et al. | |
| 8,554,140 | B2 | 10/2013 | Klemmensen et al. | |
| 2006/0271207 | A1* | 11/2006 | Shaw | A61G 7/05776 700/17 |
| 2013/0135160 | A1* | 5/2013 | Dixon | H01Q 1/44 343/720 |
| 2013/0189925 | A1 | 7/2013 | Staskawicz et al. | |
| 2013/0289770 | A1* | 10/2013 | Rawls-Meehan | G05B 15/02 700/275 |

OTHER PUBLICATIONS

Non-Final Office Action dated Sep. 24, 2014 in U.S. Appl. No. 13/749,108, 7 pages.
Notice of Allowance dated Feb. 23, 2015 in U.S. Appl. No. 13/749,108, 8 pages.

* cited by examiner

*Primary Examiner* — Toan N Pham
(74) *Attorney, Agent, or Firm* — Shook, Hardy & Bacon, L.L.P.

(57) ABSTRACT

A system, method, and device for automatic master control detection are provided. In embodiments, automatic master control detection may be utilized to determine a primary control device in a multi-control furniture environment, such as an automated furniture environment. In some aspects, a control device is initially programmed with a particular primary ID. Additionally, such control devices include an alternate ID that may replace the primary ID if it is determined that a conflict exists between the control device and another control device in the same network environment. In one embodiment of the invention, a control device/box/component communicates a startup query upon activation, which automatically signals to other devices in the network that it is the first control started and will retain master control status having the primary ID. Recipient control devices may process a received startup query as an indication to change their primary ID to an alternate ID.

17 Claims, 7 Drawing Sheets

REMOTE AND CONTROLLER SYNCHRONIZATION FOR AUTOMATED FURNITURE CONTROLS

CROSS-REFERENCE TO RELATED APPLICATIONS

This application claims priority to and is a continuation-in-part of U.S. Nonprovisional application Ser. No. 13/749,108, filed Jan. 24, 2013, entitled "Remote and Controller Synchronization for Automated Furniture Controls," now U.S. Pat. No. 9,070,280, the entire contents of which are hereby incorporated by reference.

STATEMENT REGARDING FEDERALLY SPONSORED RESEARCH OR DEVELOPMENT

Not applicable.

TECHNICAL FIELD

Embodiments of the present invention generally relate to a system and method for synchronizing automated furniture remotes and controllers. More particularly, embodiments of the present invention relate to a system and method for automatically pairing a wireless, remote device with a control component of an automated furniture item such that the remote device may communicate commands to the control component, and the control component may receive and execute such commands. Further embodiments of the invention relate to the automated synchronization of a remote device with multiple control components coupled to multiple automated furniture items, such as the automated synchronization of control components on adjacent adjustable furniture items. In one embodiment, the invention relates to coordinated controls of adjacent adjustable bed bases that support a shared mattress.

BACKGROUND OF THE INVENTION

A variety of methods exist for pairing wireless remotes to the control components of automated furniture items. For some automated furniture items, a manufacturer may pre-program a control component to pair the control component with a particular remote device provided to the user at the time of purchase. Alternatively, a user may purchase a wireless remote device from a third-party manufacturer, which requires manual pairing of the third-party remote device to a control component of an automated furniture item. Manual pairing of the third-party remote device to the automated furniture item may require physical manipulation of one or both of the control component and the remote device. For example, a wireless, third-party remote device may be paired to a control component using manual entry, by a user, of a particular key code or synchronization logic, or by depressing and holding a button on the device for a specified amount of time. Additionally, the pairing of a remote device to simultaneously control multiple control components may require physical manipulation of multiple control component features, and may be further limited by conflicting messages received by each of the control components.

Accordingly, a need exists for an automated method of pairing wireless, remote devices to control components of automated furniture items, without the need to manually synchronize either the control components or the remote devices.

BRIEF SUMMARY OF THE INVENTION

The present invention generally relates to a system and method for synchronizing automated furniture remotes and controllers. More particularly, embodiments of the present invention relate to a system and method for pairing a wireless, remote device with a control component of an automated furniture item such that the remote device may communicate commands to the control component, and the control component may receive and execute such commands. Embodiments of the invention include a system and method for pairing a wireless remote device to a control component using a universal mode or a normal mode, and for executing commands received by the control component from the automatically-paired remote device. In further embodiments of the invention, a system and method is provided for pairing a wireless remote device with multiple control components of multiple automated furniture items. For example, embodiments of the invention relate to pairing a common remote control to multiple control components for synchronized control of the otherwise individually controlled furniture items, such as a common remote control that provides commands to adjacent automated furniture items that respond with coordinated execution of the received commands.

In one illustrative embodiment of the invention, a system for automatically determining a primary control device in a multi-control automated furniture environment is provided. The system includes a first control box coupled to a first component of an automated furniture item, said first control box comprising a first wireless communication device having a primary ID and at least one alternate ID, said first wireless communication device configured to communicate in a network environment. The system further includes a second control box coupled to a second component of an automated furniture item, said second control box comprising a second wireless communication device having the primary ID and at least one alternate ID, said second wireless communication device configured to communicate in the network environment, wherein each of the first and second control boxes are configured to: 1) generate a startup query upon activation in the network environment, 2) receive an indication of a startup query generated by another control box activated in the network environment, and 3) change its primary ID to one of the at least one alternate ID's upon receiving the indication of a startup query generated by another control box activated in the network environment, wherein one or more features of the automated furniture item are controlled by commands received from at least one remote device in the network environment, said commands corresponding to the primary ID.

In another illustrative aspect, a method of automatically configuring multiple control components for coordinated control associated with an automated furniture item is provided. The method includes: receiving, by a first control box, an indication of a startup query from a second control box; identifying a conflict based on the first control box and the second control box comprising the same primary ID; changing, at the first control box, from the primary ID to an alternate ID; and executing one or more commands from at least one remote device, said one or more commands directed to the first control box via the second control box.

According to a third illustrative aspect, an automated furniture item control component for automatic master control detection in a multi-control environment is provided. The control component includes a wireless communication device configured to communicate in a network environment. The control component further includes an identification number associated with the control component, wherein the identification number comprises one of: 1) a primary ID; and 2) a predefined alternate ID. In further aspects, upon receiving an indication of a startup query from another control component in the network environment having the same primary ID as the control component, the control component is configured to automatically change its identification number from the primary ID to the predefined alternate ID.

Additional objects, advantages, and novel features of the invention will be set forth in part in the description which follows, and in part will become apparent to those skilled in the art upon examination of the following, or may be learned by practice of the invention.

BRIEF DESCRIPTION OF SEVERAL VIEWS OF THE DRAWING

The present invention is described in detail below with reference to the attached drawing figures, wherein.

DETAILED DESCRIPTION OF THE INVENTION

Figure 1:
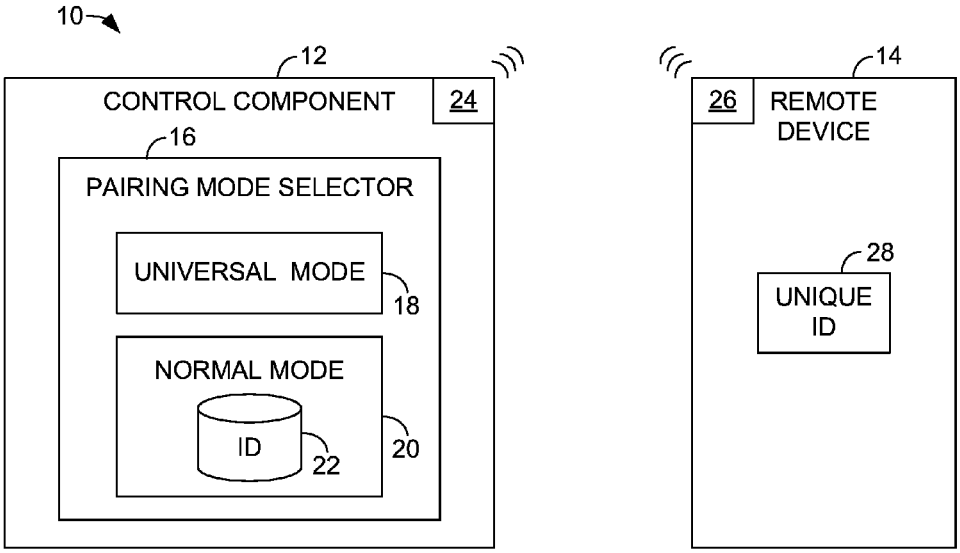
FIG. 1 is a system for automatically pairing a wireless, remote device with a control component of an automated furniture item, in accordance with an embodiment of the invention.

An embodiment of a system 10 for automatically pairing a wireless, remote device with a control component of an automated furniture item is seen in FIG. 1. The system 10 generally includes a control component 12 in wireless communication with a third-party, remote device 14. Further, the control component 12 includes a pairing mode selector 16, having both a universal mode selector 18 and a normal mode selector 20. The normal mode selector 20 is associated with an identification (ID) database 22. Control component 12 also includes a wireless communication device 24 in wireless communication with the wireless communication device 26 of remote device 14.

In one embodiment, control component 12 controls various features of an automated furniture item based on commands received by the control component 12 from a remote device. For example, the control component 12 may control integrated features that operate the automated furniture item, such as a head motor that raises and lowers the head of an adjustable bed. In further embodiments, the control component 12 may control one or more automated furniture accessories coupled to the control component 12. As such, a wireless, remote device 14 paired with the control component 12 may communicate commands for one or more features, integrated or external to the automated furniture item, that are executed by the control component 12. In embodiments of the invention, a control component 12 receives and executes commands from the remote device 14 upon pairing of the particular remote device 14 and the particular control component 12. Accordingly, automatic "pairing" of a third-party remote device 14 to the control component 12 may enable two-way communication between the control component 12 and the remote device 14 that would not otherwise be authorized and/or enabled without manual pairing.

In some embodiments, the control component 12 includes a processor and a memory capable of receiving and executing commands that are identifiable by the firmware of the control component 12. For example, the control component 12 may process commands received from a remote device 14, and may also initiate requests for information from the remote device 14. Control component 12 also includes a pairing mode selector 16 having both a universal mode selector 18 and a normal mode selector 20. As described below, the control component 12 and the remote device 14 may be paired in universal mode based on receiving an indication of a universal mode selection, while the control component 12 may be paired in normal mode based on receiving an indication of a normal mode selection.

In embodiments, universal mode may be used to automatically pair a control component 12 and a remote device 14, regardless of the particular unique ID 28 of the remote device 14. In one example, any remote device 14 from a third party manufacturer (i.e. an "after market" remote, not provided with the purchase of the automated furniture item) may control an automated furniture item in universal mode, as the control component 12 executes any command received in universal mode. Accordingly, a remote device 14 may be automatically paired to a control component 12 in universal mode upon receipt of an initial command from the remote device 14. In another embodiment, a control component 12 in normal mode must first determine whether the unique ID 28 of the remote device 14 corresponds to an ID in an ID database 22. In one example, normal mode is used to automatically pair a control component 12 to particular remote devices 14 from third party manufacturers (i.e. those with the correct unique ID 28). As such, a remote device 14 may be automatically paired to a control component 12 in normal mode upon both receiving an initial command from the remote device 14 and determining that the unique ID of the remote device 14 corresponds to an ID in an ID database 22.

In further embodiments, wireless communication device 24 may be used in the transmission of data between the control component 12 and the paired remote device 14. As such, wireless communication device 24 may be any wireless communication device used to transmit wireless communication to and from one or more remote devices 14 that communicate wirelessly with the control component 12. For example, the wireless communication device 24 may be a wireless device that executes a two-way communication protocol, such as a MiWi and/or Zigbee protocol. In some embodiments, wireless communication device 24 is used to communicate wirelessly between the control component 12 and the wireless communication device 26 of remote device 14. Wireless communication device 26 may also be a wireless device that executes a two-way communication protocol, such as a MiWi and/or Zigbee protocol.

In a first example, the control component 12 may be automatically paired, in universal mode, to the remote device 14. In one embodiment, having received an indication of universal mode selection by universal mode selector 18, the control component 12 continuously accepts commands from all available remote devices 14. Upon receipt of a command from a remote device 14, the control component 12 is automatically paired with the remote device 14. As a result, the control component 12 may add the unique ID 28 of the remote device 14 to a database of trusted remote IDs. In other words, the control component 12 may be paired with any remote device 14, regardless of the particular unique ID 28. In one embodiment, the number of remote devices 14 that may be paired to a particular control component 12 may be fixed when in universal mode, such that a limit is set on the maximum number of paired remote devices 14. In further embodiments, a database of trusted remote IDs generated during pairing in universal mode is cleared upon a power cycle of the control component 12. Accordingly, the next time the control component 12 is turned on, a new database of trusted remote IDs may be established upon pairing.

In another example, the control component 12 may be automatically paired, in normal mode, to the remote device 14. In one embodiment, having received an indication of normal mode selection by normal mode selector 20, the control component 12 executes commands from remote device 14 having an associated unique ID 28 that corresponds to a unique ID in ID database 22. For example, ID database 22 may include a list of unique IDs for any number of remote devices 14 authorized for pairing with the control component 12 when in normal mode. As such, the control component 12 may receive a command from a remote device 14 that is not executed by the control component 12 until confirmation that the unique ID 28 of the remote device 14 is included in ID database 22.

As noted in the universal mode and normal mode pairing examples above, in some embodiments, a specific number of remote devices 14 may be paired with a control component 12. Accordingly, in some embodiments, multiple remote devices 14 may be used to control a single, automated furniture item having a single control component 12. In another embodiment, a single remote device 14 may be used to control multiple automated furniture items having separate control components 12. As such, by utilizing the unique ID 28 to automatically pair in universal mode, the control component 12 may recognize which remote devices 14 will communicate commands. Similarly, by utilizing the unique ID 28 to automatically pair in normal mode, the control component 12 confirms the pairing of remote devices 14 having unique IDs 28 that correspond to the ID database 22.

Figure 2:
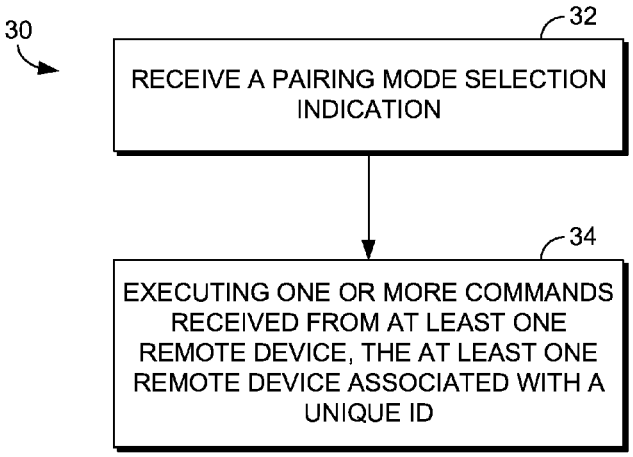
FIG. 2 is flow diagram of a method for automatically pairing a wireless, remote device with a control component of an automated furniture item, in accordance with an embodiment of the invention.

Referring next to FIG. 2, an exemplary flow diagram 30 depicts a method for automatically pairing a wireless, remote device with a control component of an automated furniture item. A pairing mode selection indication is received at block 32. In one embodiment, receiving a pairing mode selection indication comprises receiving an indication of a universal mode selection or an indication of a normal mode selection. The control component may receive an indication of a universal mode selection or an indication of a normal mode selection in a variety of ways, including communication to the control component by manipulation of a switch or other manual and/or automatic feature of the control component. In some embodiments, the control component may already be set to universal mode or normal mode when provided to a user, such that the "received" indication of a pairing mode selection is provided prior to user manipulation of the automated furniture item. In one example, the control component receives an indication of a universal mode selection or a normal mode selection when power is provided to the control component, and the control component is turned on in a pre-selected mode.

At block 34, commands received from at least one remote device are executed. The at least one remote device is associated with a unique ID. Accordingly, based on a successful pairing of a control component and a remote device, received commands may be executed by the control component.

In embodiments, a control component in universal mode receives a command from a remote device, and is automatically paired to the remote device upon receipt of the command. In one example, automatically pairing the remote device in universal mode may also include transmitting a token key command comprising a request for the unique ID of the remote device, and adding the unique ID of the remote device to a database of trusted remote IDs. As discussed above, the unique ID of the remote device may be used for recognition of which remote devices are paired in universal mode.

In further embodiments, a control component in normal mode receives a command from a remote device, and is automatically paired to the remote device upon confirmation that the remove device's unique ID corresponds to an ID in the ID database. The control component in normal mode may also transmit a token key command comprising a request for the unique ID of the remote device, for comparison with the ID database, and confirmation of the authority to execute commands received from such remote device.

Figure 3:
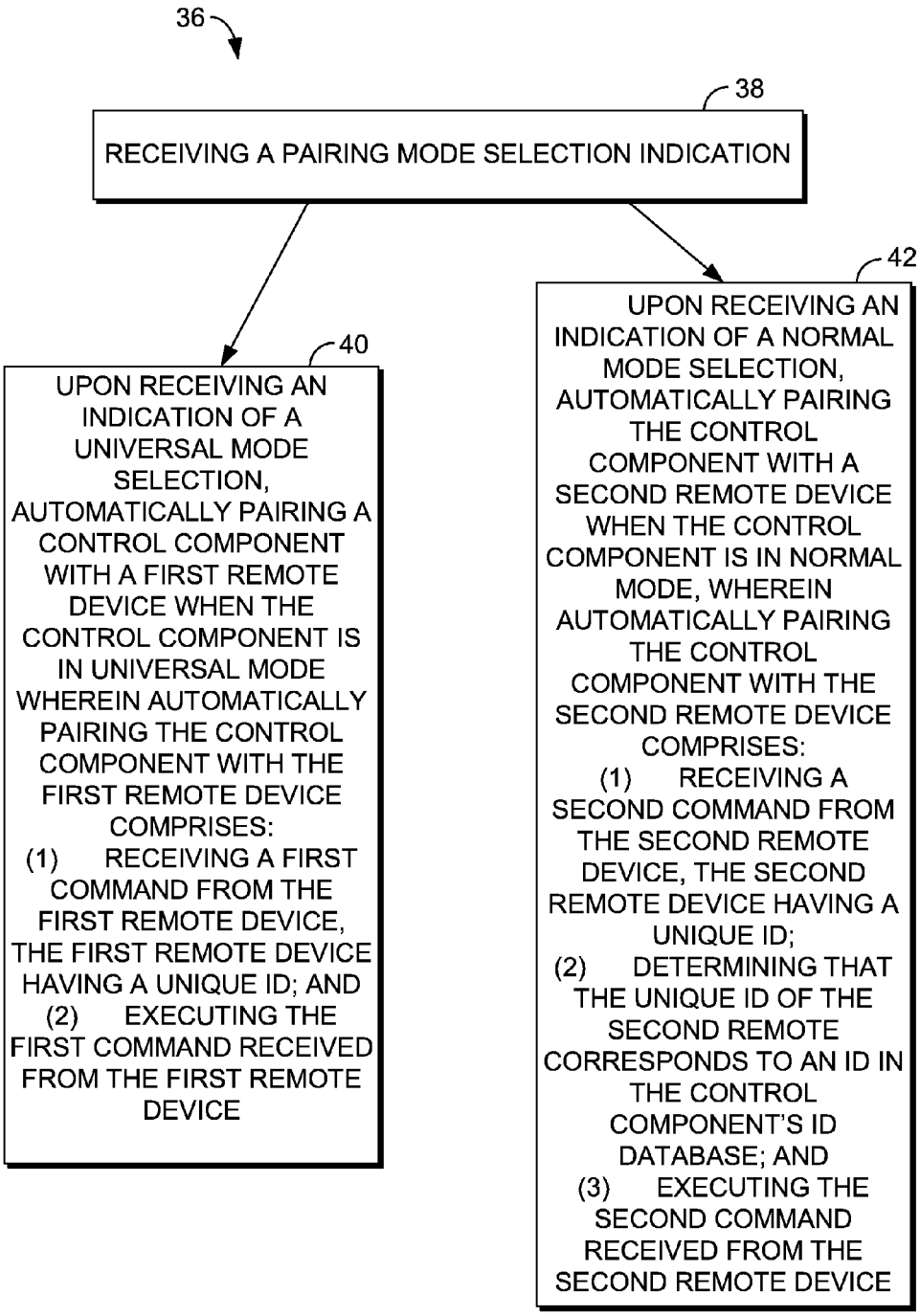
FIG. 3 is a flow diagram of a method for automatically pairing a wireless, remote device with a control component of an automated furniture item, in accordance with an embodiment of the invention.

Turning next to FIG. 3, flow diagram 36 depicts a method for automatically pairing a wireless, remote device with a control component of an automated furniture item. At block 38, a pairing mode selection indication is received. At block 40, having received a universal mode selection indication, a control component is automatically paired with a first remote device when the control component is in universal mode. In one embodiment, automatically pairing the control component with the first remote device comprises: 1) receiving a first command from the first remote device, the first remote device having a unique ID; and 2) executing the first command received from the first remote device. At block 42, having received an indication of a normal mode selection, the control component is automatically paired with a second remote device when the control component is in normal mode. In another embodiment, automatically pairing the control component with the second remote device comprises: 1) receiving a second command from the second remote device, the second remote device having a unique ID; 2) determining that the unique ID of the second remote corresponds to an ID in the control component's ID database; and 3) executing the second command received from the second remote device.

In embodiments of the invention, automatic pairing in universal mode may include transmitting a token key command comprising a request for the unique ID of a remote device, and adding the unique ID of the remote device to a database of trusted remote IDs. In further embodiments, automatic pairing may also include determining a priority for the remote device compared to one or more other remote devices communicating with the control component. In some embodiments, as multiple remote devices may be paired to a single control component, the control component may apply varying levels of priority and/or control to the multiple remote devices, such as restrictions on a level of control available to a particular remote device. In one example, a remote device may be automatically paired to the control component in universal mode, but the control component may assign a lower priority to commands received from the particular remote device based on the timing of the pairing compared to an earlier paired remote device. In doing so, the unique ID of each remote device is used to distinguish between commands received from each device. In further embodiments, the unique ID associated with a remote device may be used to authorize varying levels of control based on an identity of a user associated with a particular remote device, such as a child's remote device receiving restricted control.

In some embodiments, automatic pairing in normal mode may also include determining a priority for a remote device compared to one or more other remote devices communicating with the control component. For example, the control component's ID database may include a priority for receipt of commands from the corresponding remote devices. In another embodiment, a control component paired in normal mode to a remote device may execute commands received from a remote device according to particular restrictions for the particular remote device, as identified using the unique ID of the remote device. For example, particular remote devices may be given certain "authority" over particular functions of an automated furniture item. Accordingly, the control component may receive commands from a remote device having a unique ID listed in the ID database, but may only execute particular commands from the identified remote device. For example, although a unique ID of a remote device corresponds to the IDs in the ID database, the control component may only execute commands for particular functions of the automated furniture item. In embodiments, the unique ID of the remote device may be used to assign levels and/or degrees of control to particular users of an automated furniture item. In the example of multiple remote devices paired to a single control component, the unique IDs of the remote devices may be use to designate different levels of authority to different paired remote devices and/or different users.

Figure 4:
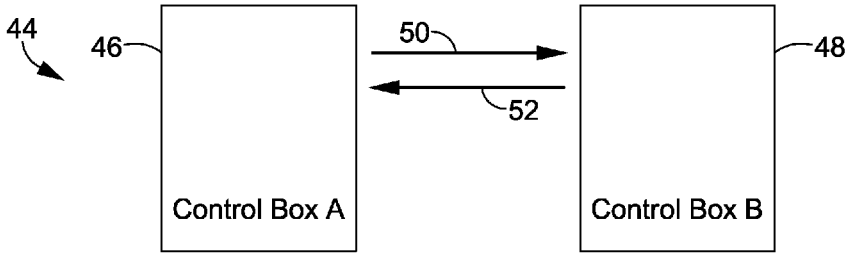
FIG. 4 is an exemplary system for automated master control detection, in accordance with an embodiment of the invention.

With reference to FIG. 4, an exemplary system 44 for automatic master control detection is provided. In this example, multiple control boxes may be configured for communication such that one or more commands received by one or more of the control boxes may be shared, received, directed, redirected, interpreted, executed, bypassed, stored, and/or otherwise processed according to embodiments of the automatic master control detection system and/or method. In one example, automatic master control detection may be used to determine a primary control device in a multi-control furniture environment, such as the dual control environment of the system 44 in FIG. 4. In this example, control box A 46 and control box B 48 may communicate information between paths 50 and 52 while determining which control box will retain primary control in the exemplary multi-control environment. In further aspects, the system 44 may be used to automatically detect and/or negotiate between multiple control boxes, such as control boxes A and B (46 and 48), to set one of the control boxes as the primary control box for receiving commands from a remote control device and directing and/or controlling a furniture item associated with both control boxes.

In one embodiment of the invention, control box A 46 and control box B 48 may be paired in a networked environment, such as paired control boxes on adjacent articulating bed foundations (e.g., two articulating twin bed foundations) that are coupled together to support a single mattress (e.g., a single king-sized mattress). Individual control boxes may be initially preprogrammed with a common identification number, such as a CANbus or LINbus ID, which may be referred to as a "primary" and/or original ID. When multiple control components having the same primary ID are paired in a networked environment, a conflict/error indication may be generated/determined by at least one of the control boxes based on a separate control box having already transmitted a startup query over the network. For example, in the paired network environment of FIG. 4, control boxes A and B (46 and 48) have the same primary ID when networked together (i.e., joined in communication via one or more pathways 50/52). Based on one of the devices starting up before the other device, the first active control box may broadcast a startup query over the network to query for available devices on the bus, according to embodiments of the invention. The second active control box (i.e., the control box that activates after the first active control box has already sent its startup query) may then receive the first control box's startup query, and a conflict and/or error may occur. In one example, a first control box A 46 having a primary ID may start up milliseconds before a second control box B 48 having the same primary ID as control box A 46.

In embodiments of the invention, in response to the conflict/error, the second active control box may automatically change its primary ID to a predefined alternate ID. As such, in some embodiments of the invention, two control boxes having matching primary IDs may automatically adjust to provide a first control box with a primary ID and a second control box with an alternate ID different from the primary ID. In further embodiments, during pairing of multiple control boxes in a multi-control environment, an error may occur when two networked control boxes have conflicting primary ID's that indicate duplicate devices (i.e., control boxes with matching primary IDs) are active within the same networked system. In order to operate the two control boxes in a synchronized fashion, and delegate primary control to a single control box that receives commands from a user remote device, embodiments of the invention automatically differentiate between the two matching control boxes. For example, in response to the error detected by either control box A 46 or control box B 48, the device detecting the error automatically changes its primary ID to a predetermined alternate ID. By changing the primary ID to an alternate ID, the secondary control box automatically resolves the conflict identified by having two control boxes with the same primary/original ID.

In some embodiments of the invention, one of multiple control boxes will identify an error and/or conflict in ID numbers associated with networked control boxes before at least one of the other control boxes identifies the error/conflict. As such, within a particular time frame, the first control box may transmit a startup query to any subsequently paired control boxes. Upon receipt of the startup query from the first control box, any subsequent control boxes networked with the first control box may identify a conflict within the network, thereby detecting that two or more control boxes have the same primary ID. Further, in response to detecting the conflict including multiple control boxes having the same primary ID, the subsequent control boxes may be configured to change their primary ID to an alternate ID different from the primary ID. In one embodiment, the transmitted startup query from the first activated control box may be interpreted as a prompt and/or instruction for the identification number of subsequently activated control boxes to be changed from their primary IDs to a predefined alternate ID.

Figure 5:
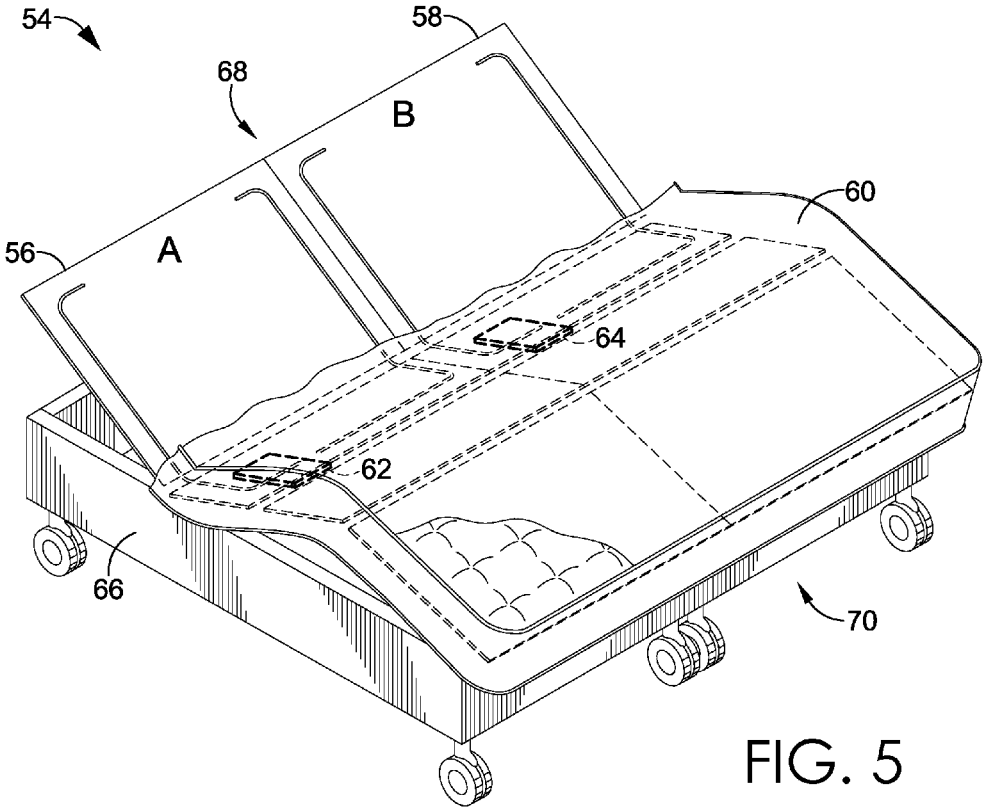
FIG. 5 is an exemplary pair of adjacent automated furniture items having control components configured for automated master control detection, in accordance with an embodiment of the invention.

Referring now to FIG. 5, an exemplary pair of adjacent automated furniture items 54 having control components for automated master control detection are provided. In this embodiment, the furniture support 56 (i.e., bed base "A") is adjacent the furniture support 58 (i.e., bed base "B") and forms a common support for the mattress 60. Further, control box 62 of the furniture support 56 and the control box 64 of the furniture support 58 are moveable between one of multiple positions based on articulation with respect to the head end 68, foot end 70, and/or surround 66 of the bed. In some embodiments, once a user has positioned the furniture support 56 adjacent the furniture support 58, a determination must be made as to which control box will determine the synchronized motion of the automated support features below the bed 60.

In one embodiment of the invention, furniture support 56 may be configured to control the automated furniture item as a unit. In other words, the manipulation of the automated furniture item may be primarily and/or exclusively controlled by the control box 62 coupled to furniture support 56. In another embodiment, the furniture support 58 may be configured to control the automated furniture item as a unit, operating the furniture supports in tandem to provide a consistent articulation supporting the mattress 60. As such, manipulation of the bed 60 may be primarily and/or exclusively controlled by the control box 64 coupled to furniture support 58. Embodiments of the invention automatically determine which control box device is to be used as the primary control device in a multi-control furniture environment, without user manipulation of manual features on either of the control boxes 62 and 64.

Figure 6:
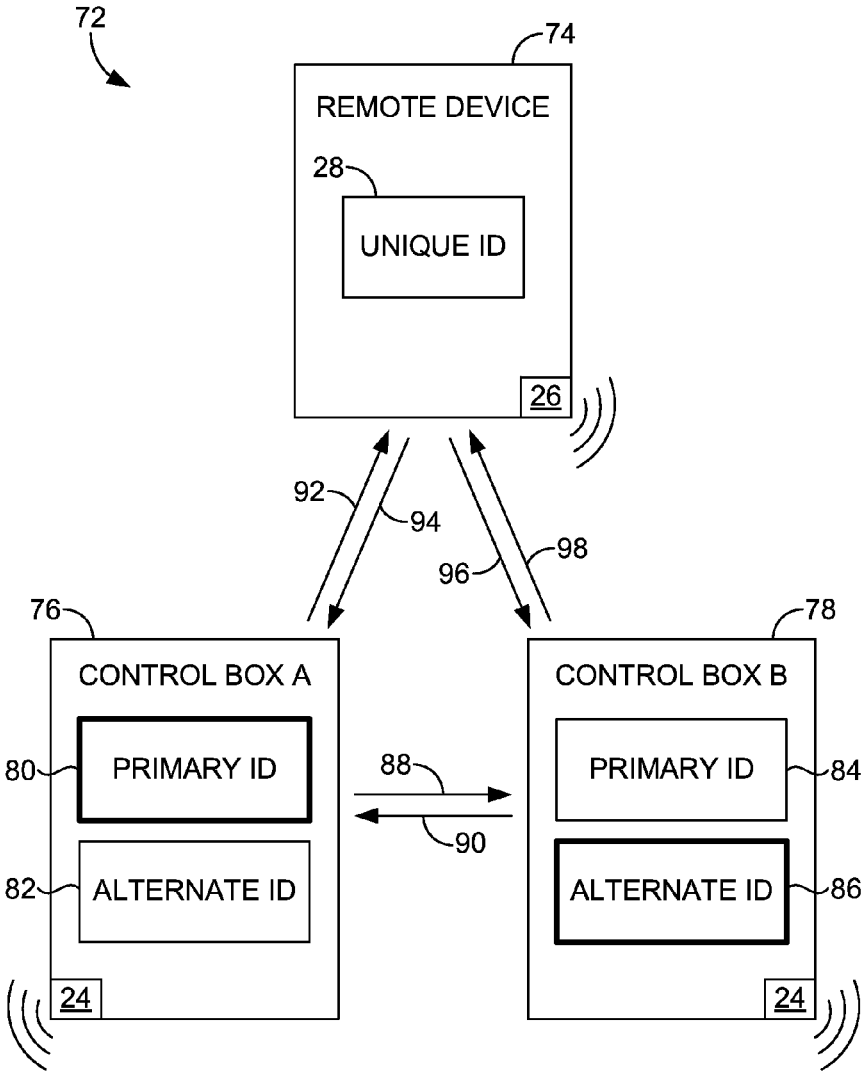
FIG. 6 is an exemplary system for automated master control detection, in accordance with an embodiment of the invention.

One embodiment of the system for automatically determining which control is the primary control, among multiple controls, is the exemplary environment 72 of FIG. 6 that includes a remote device 74 configured to wirelessly communicate with control box A 76 and control box B 78. In FIG. 6, having been activated and/or powered prior to any additional control boxes, the control box A 76 has a primary ID 80 selected, an alternate ID 82 unselected, and a startup query is transmitted from control box A 76 to control box B78. In one embodiment, the startup query between control box A 76 and control box B 78 is transmitted across a network environment based on communication paths 88 and 90, and wireless communication devices 24 on each control box. Upon receipt of the startup query from control box A 76, control box B 78 determines that an error and/or conflict exists in the identification number of the control boxes within the network, and automatically changes the primary ID 84 to the alternate ID 86. Such differentiation based on primary ID and alternate ID automatically allows the primary ID to be utilized by the first activated control box and the alternate ID to be utilized by the second activated control box. Further, having automatically assigned control boxes A and B with primary and alternate IDs, the remote device 74 is configured to communicate between the control boxes via communication paths 92, 94, 96, and 98, but need only to communicate commands to the control box having the primary ID. In embodiments, the automatic assignment of a primary ID to a single control box/component in a network environment provides the ability to direct one or more commands from a remote device to the box having the primary ID, with that box further passing the one or more commands to the control box/boxes having the alternate ID.

Figure 7:
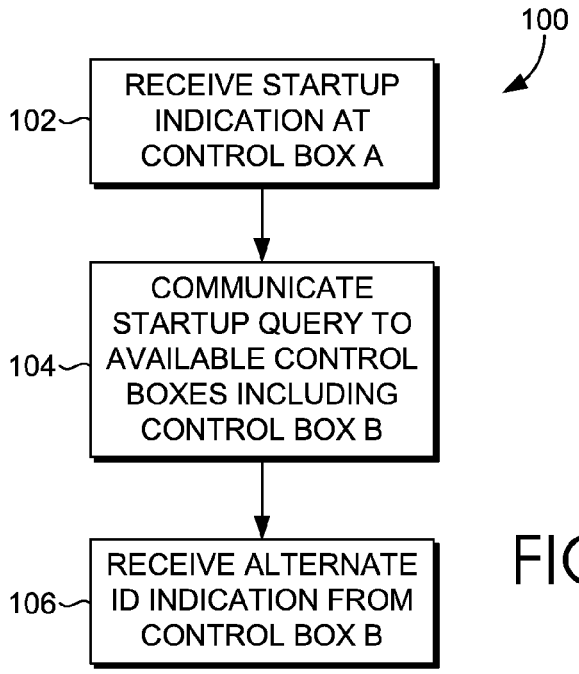
FIG. 7 is a flow diagram of an exemplary method of automated master control detection, in accordance with an embodiment of the invention.

Referring next to FIG. 7, a flow diagram 100 of an exemplary method of automated master control detection is provided in accordance with an embodiment of the invention. At block 102, a control box may receive a startup indication from a particular control box, such as control box A. At block 104, a startup query is communicated to available and/or networked control boxes including control box B. In one embodiment of the invention, an alternate ID indication is then received from control box B at block 106.

Figure 8:
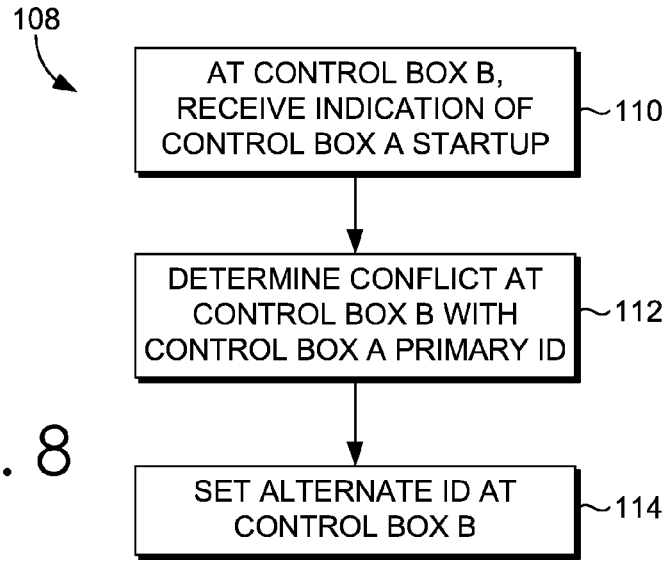
FIG. 8 is a flow diagram of an exemplary method of automated master control detection, in accordance with an embodiment of the invention.

The flow diagram 108 of FIG. 8 depicts a similar process but from a different perspective, according to one embodiment of the invention. Control box B receives an indication of control box A startup at block 110. A conflict is determined at control box B with the control box A primary ID at block 112. In embodiments, an alternate ID may then be assigned to control box B at block 114, providing an automatic master control determination that control box A is the primary control device in the network environment.

Figure 9:
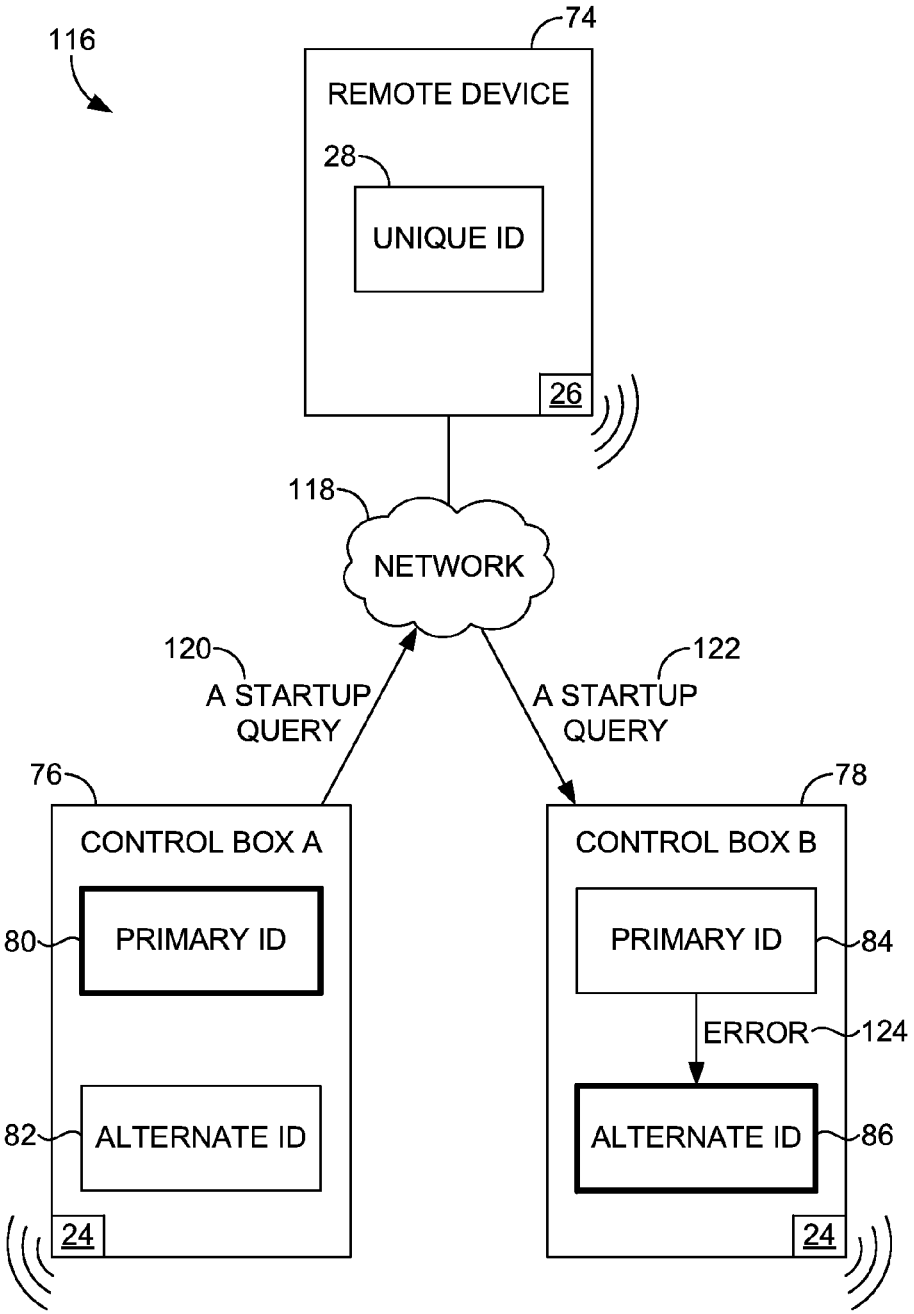
FIG. 9 is an exemplary system for automated master control detection, in accordance with an embodiment of the invention.

Turning next to FIG. 9, an exemplary system 116 for automated master control detection is provided according to an embodiment of the invention. In this embodiment, a remote device 74 is used to control an automated furniture item that includes both control box A 76 and control box B 78 that are configured to communicate in the network environment 118, such as by wireless communication devices 24 and 26. Embodiments of the automatic system are utilized for determining which control box will be configured as the master control (i.e., primary control) and which control box will be configured as a secondary control box. In FIG. 9, the control box A 76 includes a primary ID 80 and an alternate ID 82 while the control box B 78 includes a primary ID 84 and an alternate ID. The control box A 76 is configured to communicate a startup query 120 via the network 118, which provides a delivered query 122 to the control box B 78. Upon receipt of the delivered query 122, the control box B 78 may be configured to detect that an error 124 and/or conflict exists between the primary ID 80 associated with control box A 76, and the primary ID 84 associated with the control box B 78. In this example, the primary ID 80 may be identified as matching the primary ID 84. Accordingly, embodiments of the invention may automatically assign master control authority to control box A 76 by changing the primary ID 84 to the alternate ID 86, based on activation of the control box A 76 prior to the activation of control box B 78, transmission of the startup query 120, and/or receipt of the delivered query 122 prior to the delivery of a startup query from another networked control box. As such, the transmitted startup query 120 and/or delivered startup query 122 may provide an indication of a priority and/or activation order of the control box A 76, according to embodiments of the invention.

Figure 10:
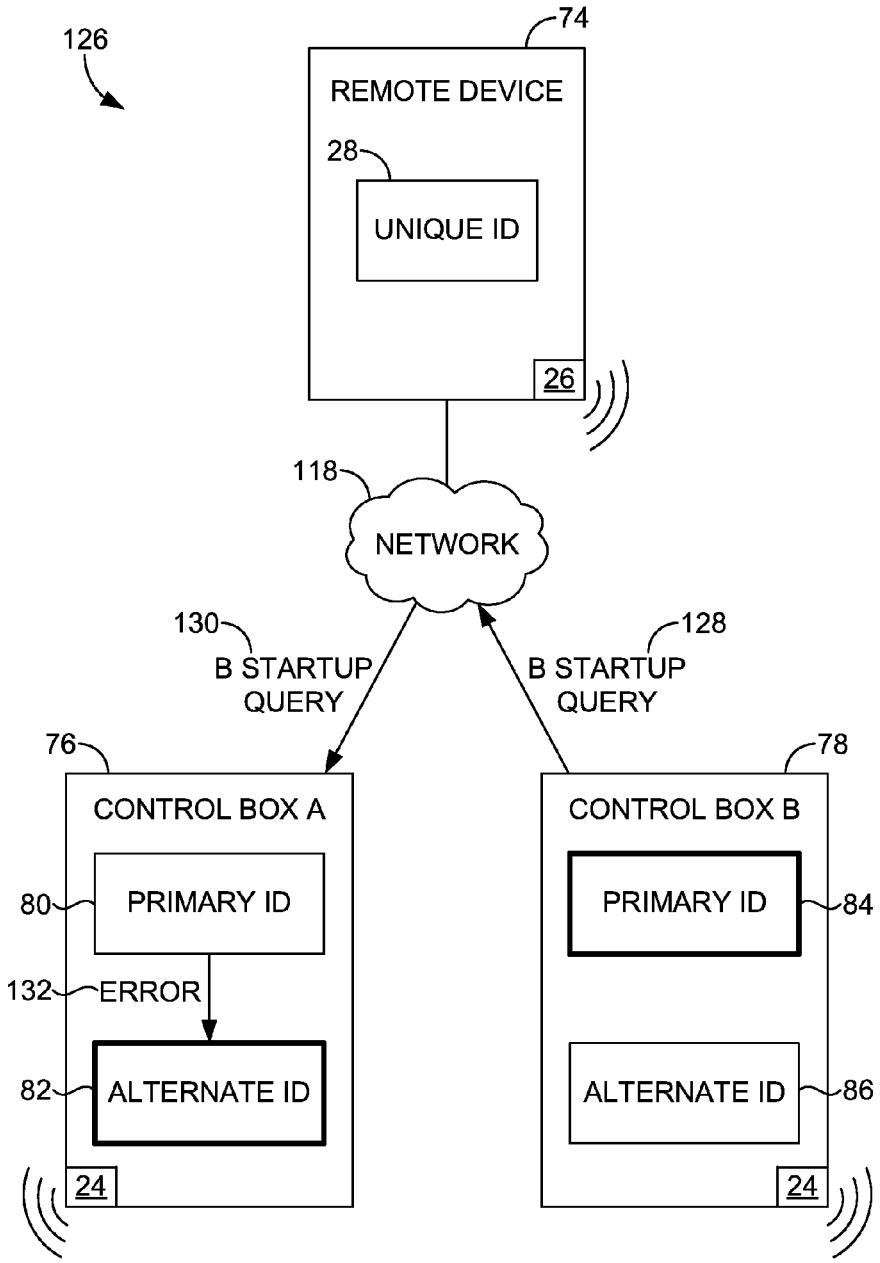
FIG. 10 is an exemplary system for automated master control detection, in accordance with an embodiment of the invention.

Similarly, as shown in FIG. 10, the exemplary system 126 for automated master control detection is provided according to an embodiment of the invention. In this embodiment, a remote device 74 is used to control an automated furniture item that includes both control box A 76 and control box B 78 that are configured to communicate in the network environment 118, such as by wireless communication devices 24 and 26. In the embodiment of FIG. 10, the control box B 78 is configured to communicate a startup query 128 via the network 118, which provides a delivered query 130 to the control box A 76. Upon receipt of the delivered query 130, the control box A 76 may be configured to detect that an error 132 and/or conflict exists between the primary ID 80 associated with control box A 76, and the primary ID 84 associated with the control box B 78. In this example, the primary ID 80 may be identified as matching the primary ID 84. Accordingly, embodiments of the invention may automatically assign master control authority to control box A 76 by changing the primary ID 80 to an alternate ID 82, based on activation of the control box B 78 prior to the activation of control box A 76, transmission of the startup query 128, and/or receipt of the delivered query 130 prior to the activation and/or delivery of a startup query from another networked control box. As such, the transmitted startup query 128 and/or delivered startup query 130 may provide an indication of a priority and/or activation order of the control box B 78, according to embodiments of the invention.

As shown in the exemplary systems of FIGS. 9 and 10, having control boxes A and B (76, 78) that are similarly configured in a network environment 118 with wireless communication devices 24, a generated, transmitted, and/or received startup query may provide an indication for automatically determining master and/or primary control status. As such, multiple control boxes having the same primary ID (80 and 84) may generate a conflict/error (124, 132) that automatically indicates 1) that multiple control boxes on the same network 118 have the same primary ID, 2) which of the multiple control boxes was activated first and therefore transmitted a startup query before other networked control boxes submitted a startup query. Such identification of the first-activated control box may be used, according to some embodiments, to automatically identify and/or determine a particular control box of the multiple control boxes to be configured as the primary control device in the network environment.

From the foregoing, it will be seen that this invention is one well adapted to attain all the ends and objects hereinabove set forth together with other advantages, which are obvious and which are inherent to the structure. It will be understood that certain features and subcombinations are of utility and may be employed without reference to other features and subcombinations. This is contemplated by and is within the scope of the claims. Since many possible embodiments may be made of the invention without departing from the scope thereof, it is to be understood that all matter herein set forth or shown in the accompanying drawings is to be interpreted as illustrative and not in a limiting sense.

The invention claimed is:

1. A system for automatically determining a primary control device in a multi-control automated furniture environment, the system comprising:

a first control box coupled to a first component of an automated furniture item, said first control box comprising a first wireless communication device having a primary ID and at least one alternate ID, said first wireless communication device configured to communicate in a network environment; and a second control box coupled to a second component of an automated furniture item, said second control box comprising a second wireless communication device having a primary ID and at least one alternate ID, said second wireless communication device configured to communicate in the network environment;

wherein each of the first and second control boxes are configured to:

(1) generate a startup query upon activation in the network environment;

(2) receive an indication of a startup query generated by the other control box activated in the network environment;

(3) identifying a conflict based on the first control box and the second control box comprising the same primary ID; and (4) the control box among the first and second control boxes that activates subsequent to the other of the first and second control boxes, change its primary ID to one of its at least one alternate IDs upon receiving the indication of the startup query generated by the other of the first and second control boxes that is activated in the network environment, wherein one or more features of the automated furniture item are controlled by commands received from at least one remote device in the network environment, said commands corresponding to the primary ID.

2. The system of claim 1, wherein generating the startup query comprises communicating the startup query to all control boxes in the network environment.

3. The system of claim 1, wherein upon receiving, by the first control box, the indication of the startup query generated by the second control box activated in the network environment prior to activation of the first control box in the network environment, the first control box is configured to change its primary ID to one of the at least one alternate IDs.

4. The system of claim 1, wherein upon receiving, by the second control box, the indication of the startup query generated by the first control box activated in the network environment prior to activation of the second control box in the network environment, the second control box is configured to change its primary ID to at least one of the at least one alternate IDs.

5. The system of claim 1, wherein the control box that retains the primary ID is configured to receive one or more commands from the remote device.

6. The system of claim 5, wherein the control box that changes its ID to the alternate ID is configured to receive one or more commands from the control box that retains the primary ID.

7. A method of automatically configuring multiple control components for coordinated control associated with an automated furniture item, the method comprising: receiving, by a first control box, an indication of a startup query from a second control box; identifying a conflict based on the first control box and the second control box comprising a same primary ID; changing, at the first control box, from the primary ID to an alternate ID; and executing one or more commands from at least one remote device, said one or more commands directed to the first control box via the second control box.

8. The method of claim 7, wherein receiving, by the first control box, the indication of the startup query from the second control box comprises receiving an indication from the second control box communicating in a same network environment as the first control box and having activated prior to the first control box being activated.

9. The method of claim 8, wherein the one or more commands are directed by the second control box based on the primary ID of the second control box and the alternate ID of the first control box.

10. The method of claim 9, wherein executing the one or more commands by the second control box having the primary ID and the first control box having the alternate ID provides a synchronized control of the automated furniture item.

11. The method of claim 7, wherein identifying the conflict based on the first control box and the second control box comprising the same primary ID comprises generating, at the first control box, an error message.

12. The method of claim 11, wherein changing, at the first control box, from the primary ID to the alternate ID comprises changing the ID of the first control box from the primary ID matching the primary ID of the second control box to the alternate ID that is different from the primary ID.

13. An automated furniture item control component for automatic master control detection in a multi-control environment, the control component comprising:

a wireless communication device configured to communicate in a network environment; and an identification number associated with the control component, wherein the identification number comprises one of:

(1) a primary ID; and (2) a predefined alternate ID, wherein upon receiving an indication of a startup query from another control component in the network environment having the same primary ID as the control component, the control component is configured to automatically change its identification number from the primary ID to the predefined alternate ID.

14. The control component of claim 13, wherein commands from a remote device paired with the automated furniture item are communicated to the control component by the other control component in the network environment.

15. The control component of claim 14, wherein commands from the remote device are received by the other control component based on the other control component retaining the primary ID as its identification number.

16. The control component of claim 15, wherein automatically changing its identification number from the primary ID to the predefined alternate ID comprises identifying an error based on the primary ID of the control component being the same as the primary ID of the other control component.

17. The control component of claim 13, wherein the control component is configured to retain its primary ID as the identification number based on not receiving the startup query from another control component.

* * * * *